US011066816B2

(12) United States Patent
Kang et al.

(10) Patent No.: US 11,066,816 B2
(45) Date of Patent: Jul. 20, 2021

(54) FAUCET EXTENDER

(71) Applicant: Munchkin, Inc., Van Nuys, CA (US)

(72) Inventors: Yong Sun Simon Kang, Los Angeles, CA (US); Thomas E. Birkert, West Hills, CA (US); Mark Gerard Tebbe, Ventura, CA (US); Quinn Michael Biesinger, Los Angeles, CA (US); Nathan Lu, Belmont, CA (US)

(73) Assignee: Munchkin, Inc., Van Nuys, CA (US)

( * ) Notice: Subject to any disclaimer, the term of this patent is extended or adjusted under 35 U.S.C. 154(b) by 99 days.

(21) Appl. No.: 16/569,540

(22) Filed: Sep. 12, 2019

(65) Prior Publication Data

US 2020/0217053 A1 Jul. 9, 2020

Related U.S. Application Data

(60) Provisional application No. 62/788,606, filed on Jan. 4, 2019.

(51) Int. Cl.

| | |
|---|---|
| ***E03C 1/086*** | (2006.01) |
| ***E03C 1/04*** | (2006.01) |
| ***E03C 1/08*** | (2006.01) |

(52) U.S. Cl.

CPC ..... *E03C 1/086* (2013.01); *E03C 1/0404* (2013.01); *E03C 1/08* (2013.01); *E03C 2001/0415* (2013.01)

(58) Field of Classification Search

CPC ..... E03C 1/0404; E03C 1/08; E03C 1/086; E03C 2001/0415

USPC ..... 4/678; 137/801; 239/25, 26

See application file for complete search history.

(56) References Cited

U.S. PATENT DOCUMENTS

| | | | |
|---|---|---|---|
| 1,067,443 | A | 7/1913 | Schuchart |
| 1,203,935 | A | 11/1916 | Stringham |
| 2,171,023 | A | 12/1938 | Buxton |
| 3,462,080 | A | 8/1969 | Howard et al. |
| 4,934,597 | A | 6/1990 | Crutcher |
| 5,337,956 | A | 8/1994 | Crutcher |
| 8,276,615 | B2 | 10/2012 | Weber |
| 8,366,019 | B2 | 2/2013 | Lee |
| 8,371,514 | B2 | 2/2013 | Finell |
| D689,988 | S | 9/2013 | Lee |
| D704,309 | S | 5/2014 | Lee |
| D712,519 | S | 9/2014 | Lu |
| D720,434 | S | 12/2014 | Lu |
| 9,044,765 | B2 | 6/2015 | Lee |
| 9,060,653 | B2 | 6/2015 | Henderson et al. |
| 9,067,227 | B2 | 6/2015 | Lee |
| 9,267,271 | B2 | 2/2016 | Lu |
| 9,268,355 | B2 | 2/2016 | Lee |

(Continued)

FOREIGN PATENT DOCUMENTS

| | | | |
|---|---|---|---|
| KR | 200449629 | B1 | 7/2010 |
| KR | 101426326 | B1 | 8/2014 |

*Primary Examiner* — Tuan N Nguyen

(74) *Attorney, Agent, or Firm* — Alan D. Borelli, Esq.; Robert Z. Evora, Esq.

(57) ABSTRACT

A faucet extender having a channel adapted to extend and divert a fluid out of an open edge away from a faucet opening. The faucet extender may have a fluid outlet fitting having a receiving opening and a flow-through opening. The faucet extender may have an attachment mechanism that pivotally rotates and secures the fluid outlet fitting in an angle that diverts the fluid to the open edge. The faucet extender is adapted to interface with a variety of different faucet configurations.

19 Claims, 15 Drawing Sheets

(56) References Cited

U.S. PATENT DOCUMENTS

| | | | |
|---|---|---|---|
| 2006/0207670 | A1 | 9/2006 | Peters |
| 2007/0175531 | A1 | 8/2007 | Daniels |
| 2012/0180893 | A1 | 7/2012 | Lee |

FIG. 1
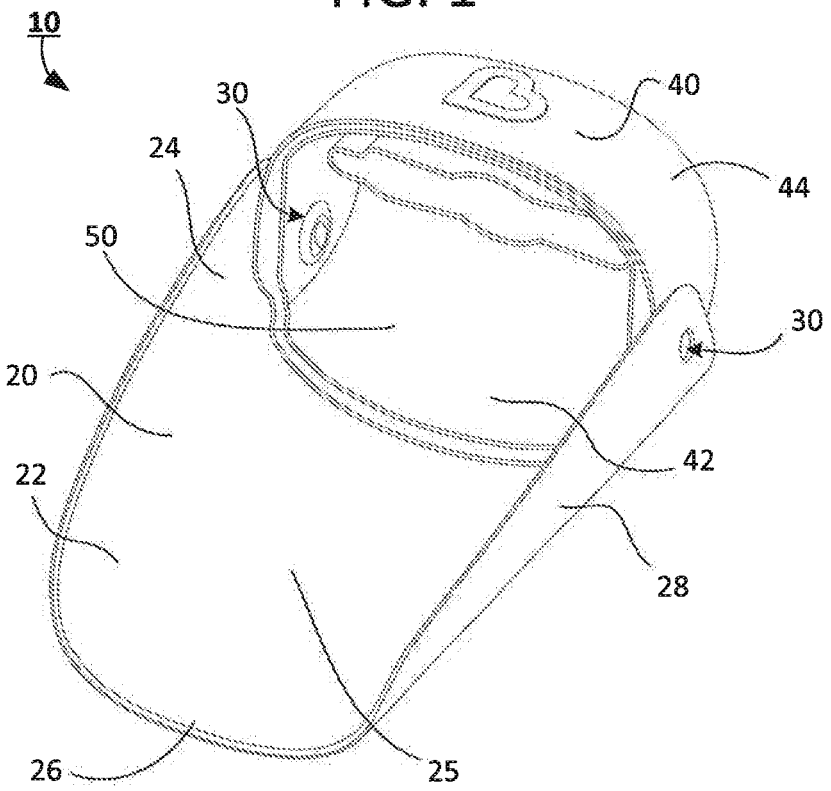
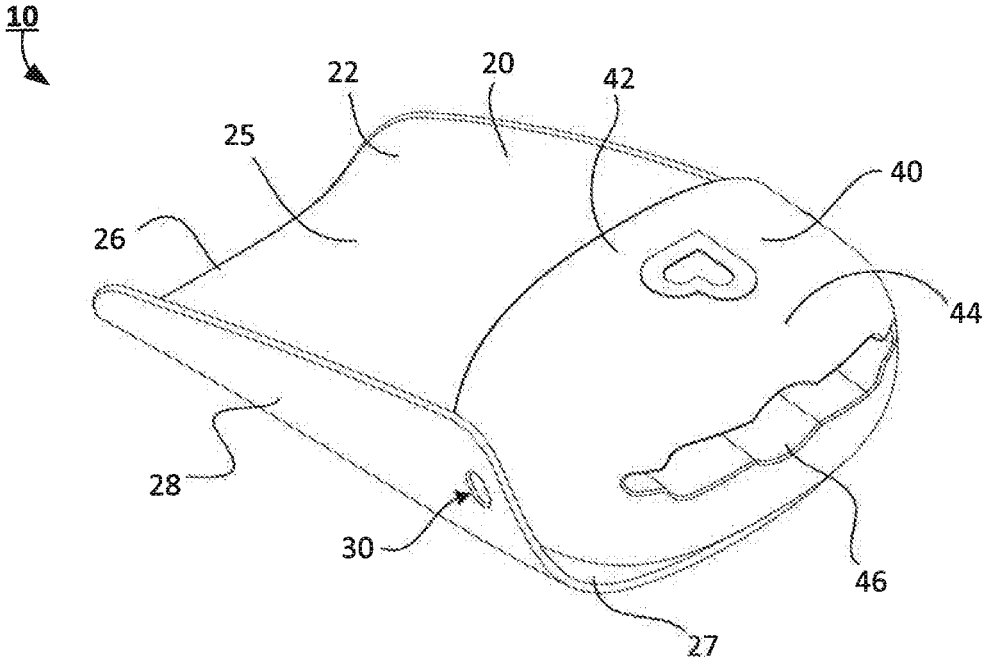
FIG. 2

FIG. 3
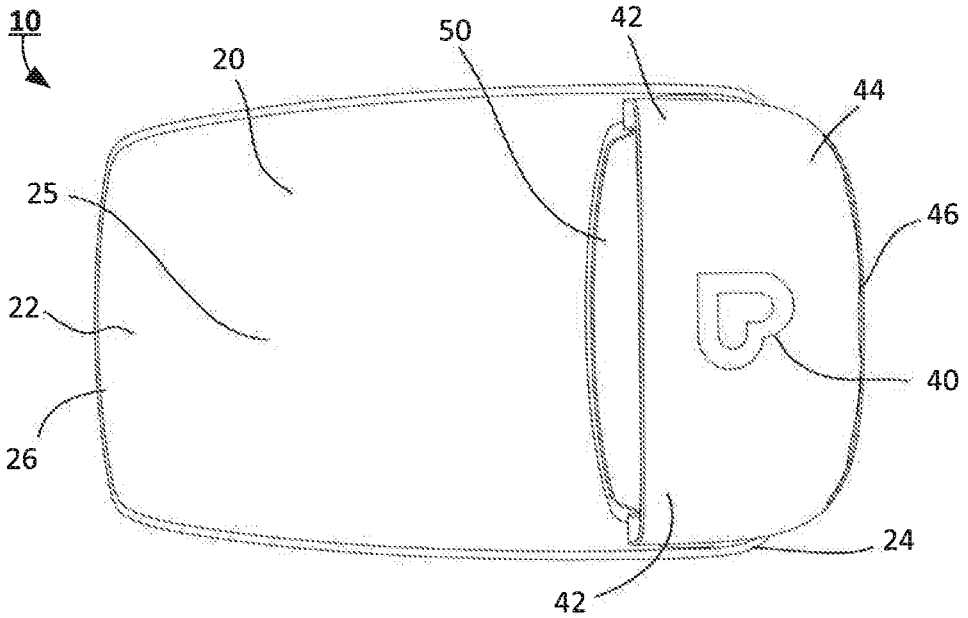
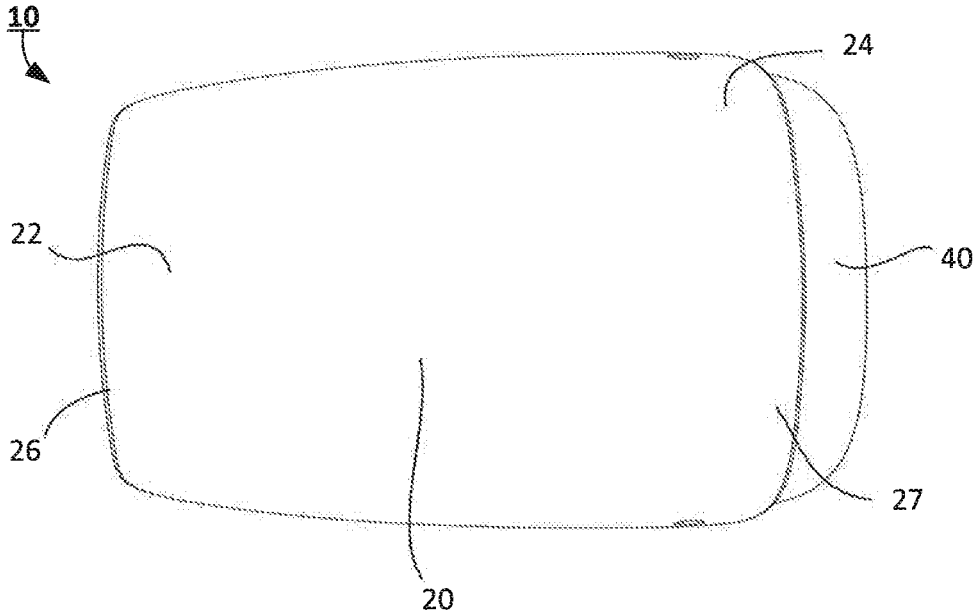
FIG. 4

FIG. 13
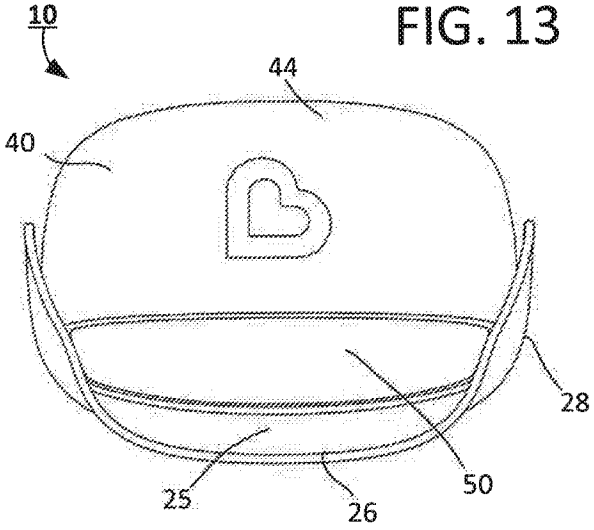
FIG. 12
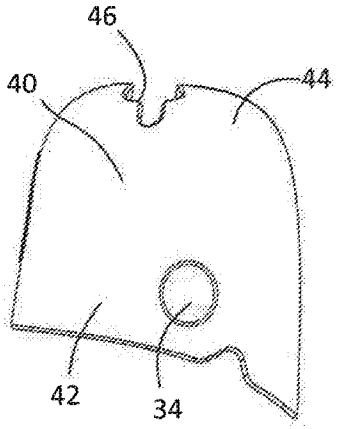
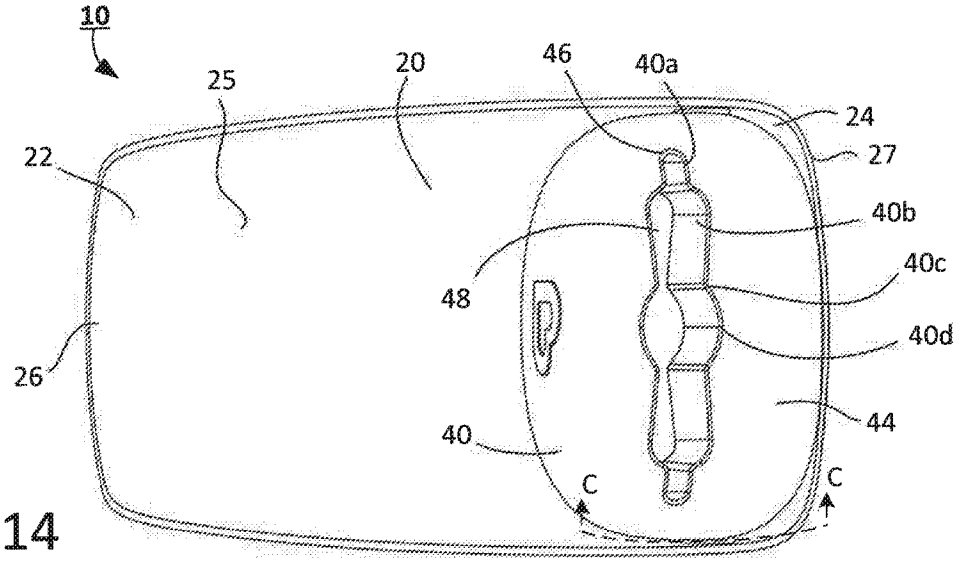
FIG. 14

FAUCET EXTENDER

CROSS-REFERENCE TO RELATED APPLICATION

This application incorporates and claims the benefit of the filing date of U.S. Provisional Patent Application Ser. No. 62/788,606, entitled "FAUCET EXTENDER" filed Jan. 4, 2019, the entirety of which is incorporated herein by reference.

TECHNICAL FIELD

The subject disclosure relates generally to a faucet extension. More specifically, to a faucet extender assembly that adopts multiple use positions to divert fluid from a faucet.

BACKGROUND

Faucet extenders address the problem of children or other users not being able to reach the spout of a faucet. However, traditional faucet extenders are generally unable to adapt to multiple faucet configurations. Furthermore, these faucet extenders are cumbersome and inefficient in extending the flow of a fluid away from a faucet. Thus, a need arises for parents or other users who want a faucet extender that is effective, easy to use and capable of adapting to multiple faucet configurations.

SUMMARY

A faucet extender having a channel adapted to extend and divert a fluid out of an open edge away from a faucet opening. The faucet extender may have a fluid outlet fitting having a receiving opening and a flow-through opening. The faucet extender may have an attachment mechanism that pivotally rotates and secures the fluid outlet fitting relative to the channel in an angle that diverts the fluid to the open edge. The faucet extender is adapted to interface with a variety of different faucet configurations.

BRIEF DESCRIPTION OF THE DRAWINGS

Various exemplary embodiments of this disclosure will be described in detail, wherein like reference numerals refer to identical or similar components or steps, with reference to the following figures, wherein:

FIG. 1 illustrates a front perspective view of a faucet extender with a faucet holder in a horizontal receiving position according to this subject disclosure.

FIG. 2 illustrates a rear perspective view of the faucet extender depicted in FIG. 1.

FIG. 3 is a top view of the faucet extender depicted in FIG. 1.

FIG. 4 is a bottom view of the faucet holder depicted in FIG. 1.

FIG. 12 is a side view of the faucet holder in the vertical receiving position detached from the main body of the faucet extender.

FIG. 13 is a front view of the faucet extender depicted in FIG. 9.

FIG. 14 is a top view of the faucet extender depicted in FIG. 9.

DETAILED DESCRIPTION

Figure 5:
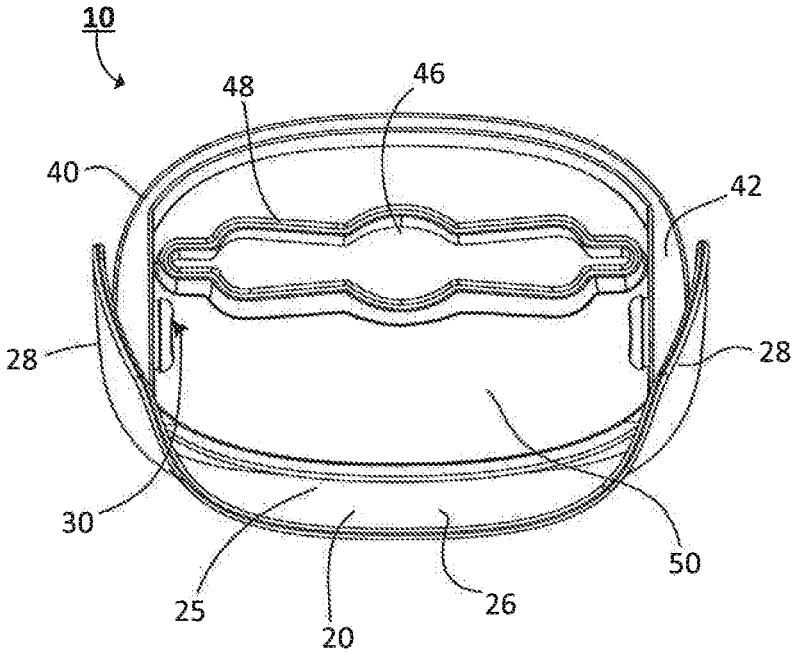
FIG. 5 is a front view of the faucet extender depicted in FIG. 1.

Particular embodiments of the subject disclosure will now be described in greater detail with reference to the figures.

FIG. 1 shows a faucet extender 10 according to this subject disclosure. The faucet extender 10 has a main body 20 and a fluid outlet fitting or faucet holder 40.

FIGS. 1-4 show the main body 20 may have a first side 22 and a second side 24. An open edge 26 may be disposed on the first side 22. A second end 27 may be disposed on the second side 24. The main body 20 may be contoured to have sidewalls 28. The sidewalls 28 define a channel or trough 25 that catches a liquid 100 from a faucet 90 and directs the flow of the liquid 100 outward off the open edge 26 and away from a second end 27 as shown in FIGS. 15-18. The sidewalls 28 may be made integral with the main body 20 or may be separate components, permanently installed or removable. Furthermore, the sidewalls 28 may be of any geometric shape suitable to direct or divert the liquid 100 toward the open edge 26.

The trough 25 and sidewalls 28 may be made of any suitable material capable of containing and/or diverting liquids therein and allowing the liquid 100 to flow, including but not limited to, rubber, plastic, metal and any other composition or the like. The trough 25 or sidewalls 28 can be flexible or more rigid in construction. In this embodiment, the trough 25 and sidewalls 28 are constructed from a single piece, but it is contemplated that the trough 25 or sidewalls 28 could be assembled from multiple different pieces. A multi-piece configuration would enable the user to adjust the length of the faucet extender 10 or position of the sidewalls 28 as needed.

In this particular embodiment, the trough 25 of the main body 20 is roughly rectangular with rounded corners. A transverse cross section of the trough 25 is substantially U-shaped. However, it is contemplated that the shape of the trough 25 of the main body 20 may be of any geometric shape suitable to direct liquid 100 toward the open edge 26. The trough 25 and sidewalls 28 could extend continuously such that a transverse cross section of the main body 20 would be substantially O-shaped. A transverse cross section of the trough 25 could also be substantially V-shaped. Furthermore, in this particular embodiment the trough 25 is substantially smooth, but the trough 25 could possess grooves, waves, channels or protuberances to guide or alter the flow of the liquid 100. The trough 25 could also curve left, right, up or down from the angle from which the liquid 100 enters the faucet extender 10.

FIG. 3 is a top view of the faucet extender 10 shown in FIG. 1. The top view shows the first side 22 and the second side 24 of the main body 20 with the fluid outlet fitting or faucet holder 40 disposed on the second side 24 of the main body 20. The main body 20 is substantially rectangular with rounded corners. The faucet holder 40 is substantially rectangular and adapted to fit within a portion of the main body 20. However, it is contemplated that the main body 20 could fit within the faucet holder 40, and that the main body 20 and faucet holder 40 could be a variety of complementary shapes adapted to direct liquid 100 toward the open edge 26.

FIG. 4 is a bottom view of the faucet holder 10 shown in FIG. 1. The bottom view shows the bottom of the main body 20 and the first side 22 and the second side 24 disposed therein. The faucet holder 40 in a horizontal receiving position extends past the edge of the second side 24 of the main body 20. However, in other embodiments the faucet holder 40 may be positioned entirely within the boundaries of a perimeter of the main body 20.

As shown in FIGS. 1-3, 5-6 and 12 the faucet holder 40 may have a first end 42 and a second end 44. The first end 42 of the faucet holder 40 may be attached to, or integral with the sidewalls 28 of the main body 20. On the first end 42 of the faucet holder 40 there may be a flow-through opening 50 designed to allow the liquid 100 from the faucet 90 to flow therethrough. Although shown in FIGS. 1-20 as substantially an entirety of the area of the transverse cross-section of the faucet holder 40, the flow-through opening 50 may be of any suitable size and shape that allows the liquid 100 from the faucet 90 to flow therethrough. It is contemplated that the flow-through opening 50 may take a variety of different sizes, such as a smaller opening, to provide more directed flow of the liquid 100 and prevent splashing.

FIG. 2 shows a rear perspective of the faucet extender 10. The rear perspective shows the second end 44 of the faucet holder 40 may have a faucet receiving opening 46. The faucet receiving opening 46 is adapted to receive and secure a horizontal faucet end 91 or vertical faucet end 92 of the faucet 90 such as shown in FIGS. 15-18 respectively.

Figure 6:
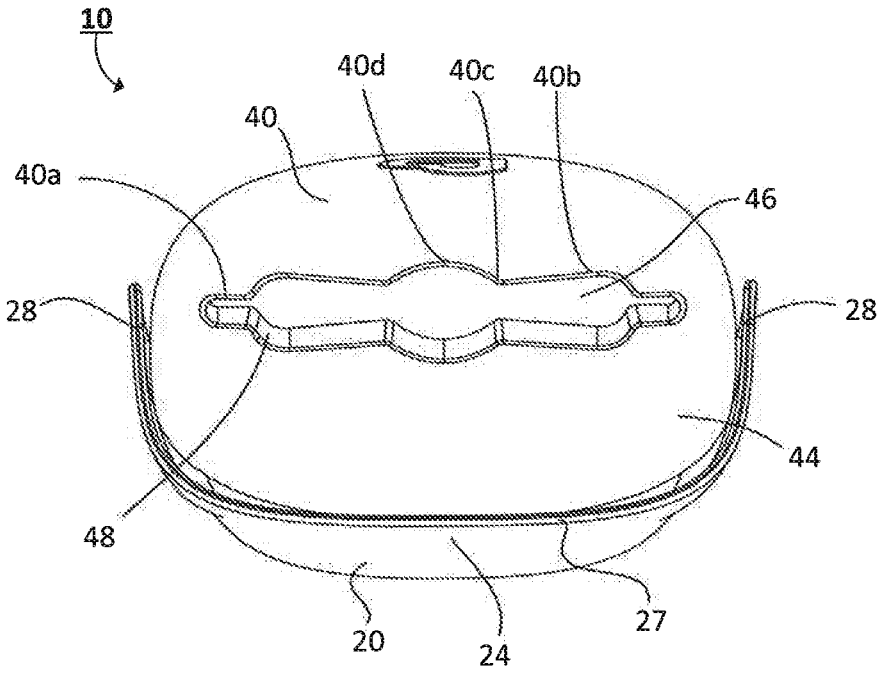
FIG. 6 is a rear view of the faucet extender depicted in FIG. 1.

FIG. 5 is a front view of the faucet extender 10 with the faucet holder 40 in a horizontal receiving position looking through the flow-through opening 50 and out of the back of the faucet receiving opening 46. FIG. 6 is a rear view of the faucet holder 40 secured within the main body 20 in a horizontal receiving position, looking in from the second side 24 toward the first side 22 of the main body 20 through the faucet receiving opening 46.

The faucet receiving opening 46 may have a variety of geometric cut shapes to provide a frictional force to secure the faucet 90 without unduly restricting installation and removal thereof. Furthermore, the geometric cut shape of the faucet receiving opening 46 may have one or more elongated lips 48, as seen through the flow-through opening 50 in FIGS. 1 and 7. The elongated lips 48 are constructed to provide additional surface area to create additional frictional force around the faucet 90 to form a tight grip thereon. Similarly, the elongated lip 48 may be of a material adapted to provide additional frictional force.

Figure 9:
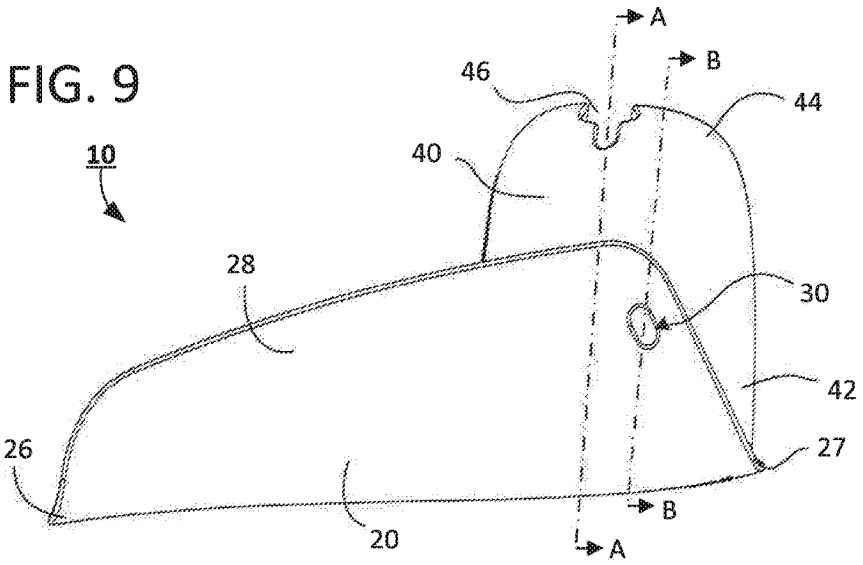
FIG. 9 is a side view of the faucet extender with the faucet holder in a vertical receiving position.
Figure 17:
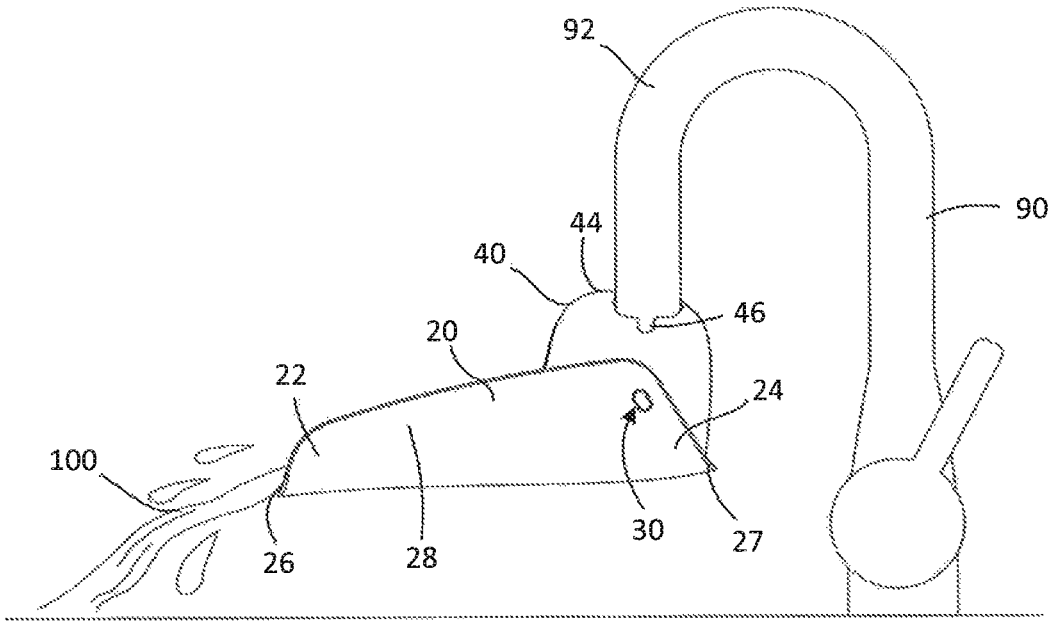
FIG. 17 is side view of the faucet holder depicted in FIG. 9 attached to the faucet in operation with the faucet holder attached to the faucet in the vertical receiving position.
Figure 18:
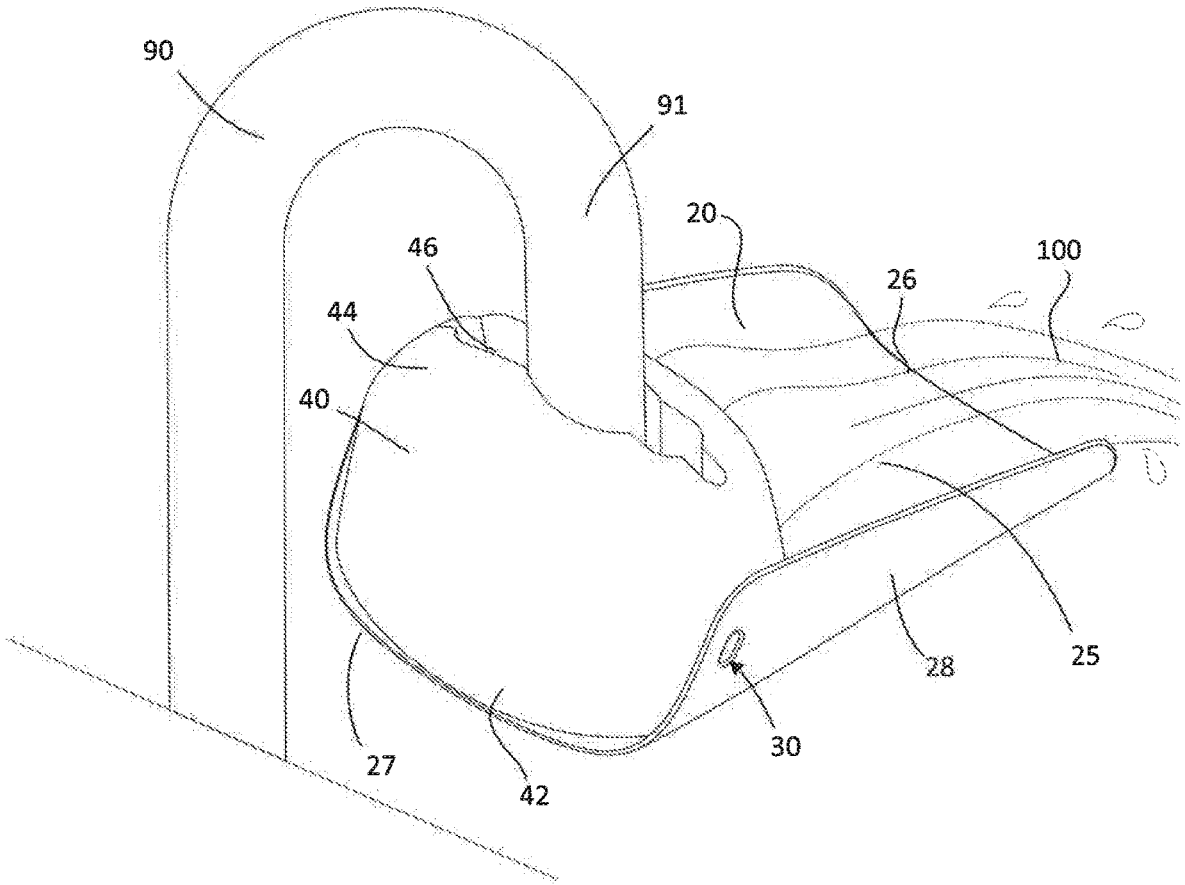
FIG. 18 shows an upper-rear perspective view of the faucet holder depicted in FIG. 9 attached to the faucet in operation.

FIG. 9 shows a side view of the faucet extender 10 with the faucet holder 40 in a vertical receiving position, adapted for the vertical configuration of the faucet 90 shown in FIGS. 17-18. The left side wall 28 is visible, as is a profile of the faucet receiving opening 46. FIG. 9 shows the location of cross-sections in FIGS. 10-11 at lines A-A and B-B respectively.

Figure 11:
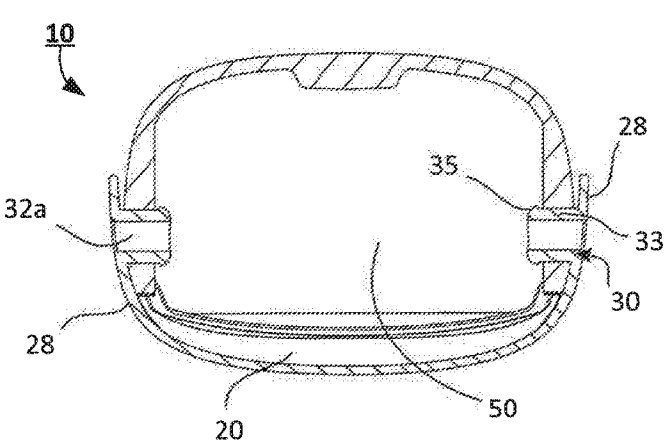
FIG. 11 is a rear-facing cross-section view at line B-B in FIG. 9.
Figure 10:
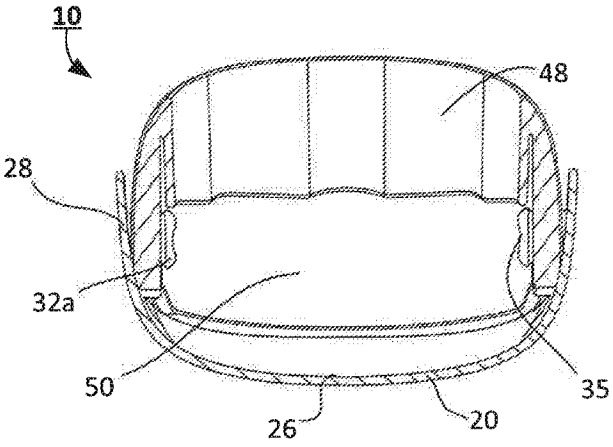
FIG. 10 is a rear-facing cross-section view at line A-A in FIG. 9.
Figure 15:
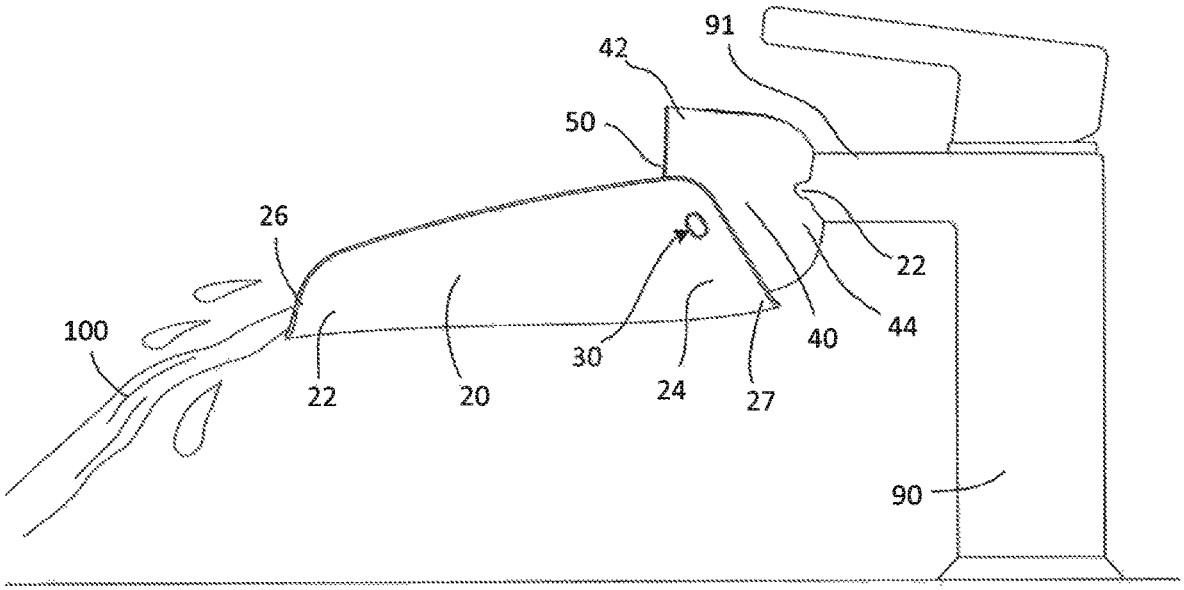
FIG. 15 illustrates a side view of the faucet holder depicted in FIG. 1 attached to a faucet in operation with the faucet holder in the horizontal receiving position.

FIG. 10 is a cross section facing the second side 24 of the main body 20 at line A-A. FIG. 10 shows additional details of the elongated lips 48. FIG. 11 is a cross section facing the second side 24 of the main body 20 at line B-B. FIG. 11 shows details of an attachment mechanism 30 between the sidewalls 28 of the main body 20 and the faucet holder 40.

FIG. 13 is a front view of the faucet extender 10 with the faucet holder 40 oriented in a vertical receiving position such as shown in FIG. 12. From this angle the side walls 28 of the main body 20 and the flow-through opening 50 on the first end 42 of the faucet holder 40 are illustrated. As shown in FIGS. 13-14, the sides of the faucet holder 40 fit substantially flush against the sidewalls 28 of the main body 20, but it is contemplated that there could be more or less space between the faucet holder 40 and the sidewalls 28 of the main body 20.

FIG. 14 is a top view of the faucet extender 10 shown in FIG. 9. This figure illustrates the faucet holder 40 positioned adjacent to the second side 24 of the main body 20 and further shows one of the possible geometric shapes of the faucet receiving opening 46. The faucet receiving opening 46 in this particular embodiment starts narrow at a perimeter portion 40*a* located on the faucet holder 40 closest to the side walls 28, and progressively extends inward and opens wider at an intermediate portion 40*b* then narrows again at narrowing portion 40*c* before opening wider again approaching a center 40*d* of the faucet receiving opening 46. At the center 40*d* of the faucet receiving opening 46, the faucet receiving opening 46 narrows at the narrowing portion 40*c* in order to better grip the faucet 90. The purpose of this configuration is to secure the faucet 90 with a friction fit as tightly as possible without unduly restricting installation and removal of the faucet extender 10. It is contemplated that the faucet receiving opening 46 may take a number of possible configurations, such as a circle, ellipse, rectangle, square, diamond, or a combination of one or more of these shapes.

FIGS. 10 and 14 show the elongated lips 48 extending into the interior of the faucet holder 40 in greater detail. FIG. 10 is a cross section of the faucet extender 10 along line A-A facing the second side 24 of the main body 20. The shape of the elongate lips 48 helps to secure the horizontal or vertical faucet end 91, 92 (as shown in FIGS. 15-18) to the faucet holder 40 by providing additional surface area for a frictional force. In this embodiment, the elongated lips 48 extend into the interior of the faucet holder 40 of the faucet receiving opening 46. The elongated lips 48 are narrow at the perimeter portion 40*a* of the faucet holder 40 nearest the sidewalls 28 and become progressively larger at the intermediate portion 40*b* moving towards a narrowing portion 40*c* before opening wider again at the center 40*d* of the faucet holder 40. The elongated lips 48 extend into the interior of the faucet holder 40 approximately halfway the length of a thickness of the faucet holder 40, but the elongated lips 38 could be made longer or shorter. Alternatively, it is to be understood that the elongated lips 38 could extend outward, and away from the interior of the faucet holder 40 to achieve a similar friction fit effect. The elongated lips 38 in an outward configuration would be external to the faucet holder 40 and would engage the faucet 90 before it is inserted into the faucet receiving opening 46.

Figure 7:
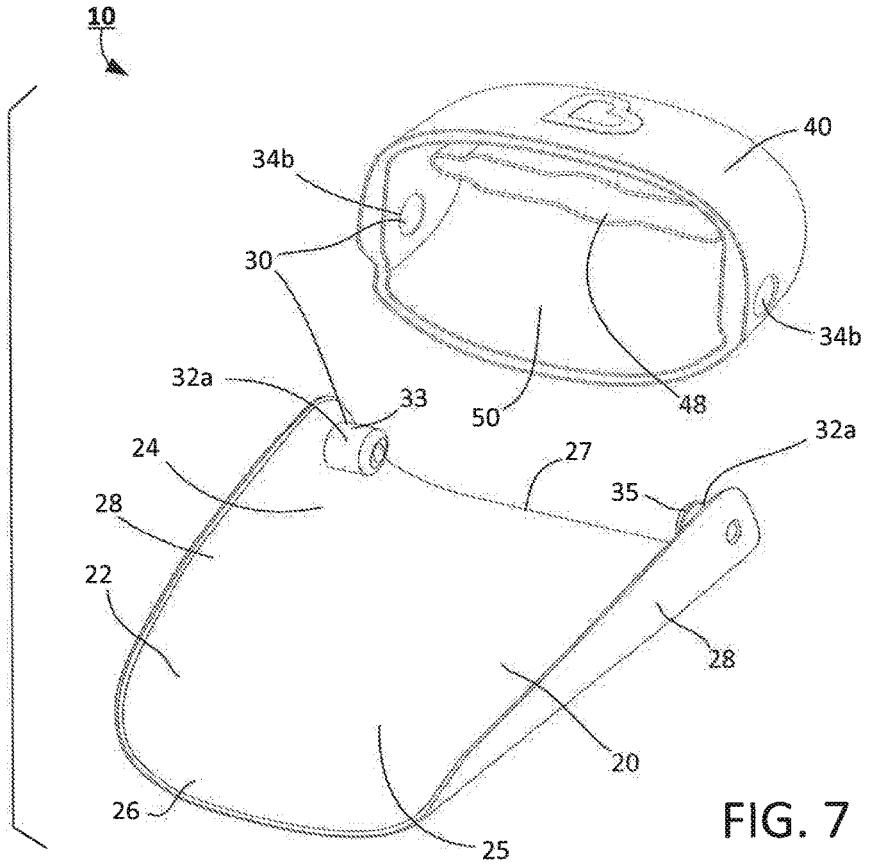
FIG. 7 illustrates an exploded front perspective view of the faucet extender depicted in FIG. 1.
Figure 8:
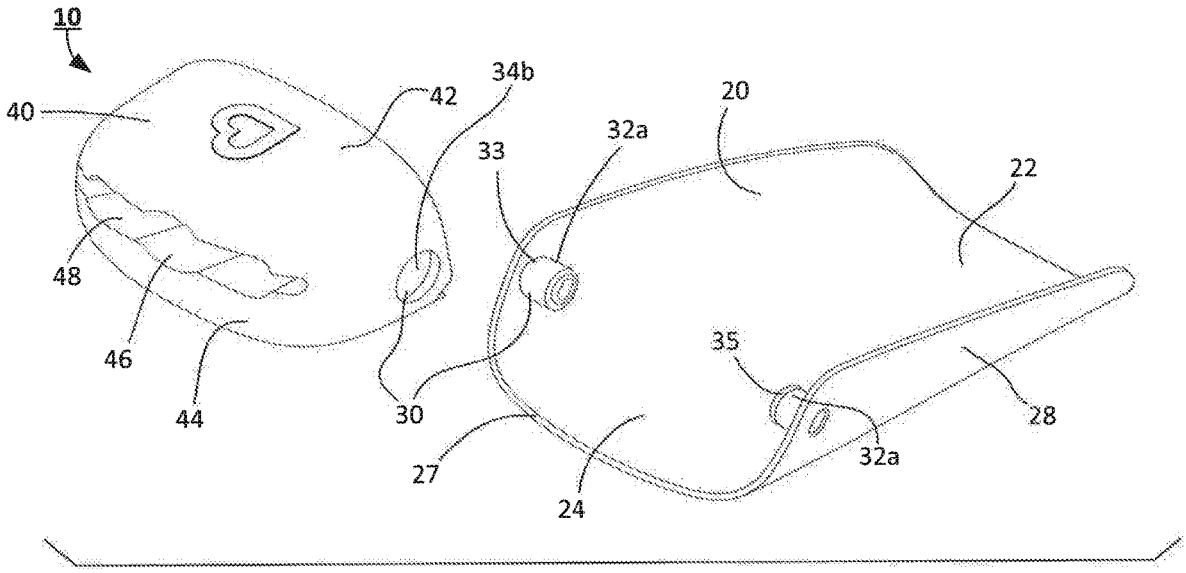
FIG. 8 illustrates an exploded rear perspective view of the faucet extender depicted in FIG. 1.

Referring back, FIGS. 7-8 show exploded front and rear perspective views of the faucet extender 10 and an exemplary attachment mechanism 30. Separate portions of the attachment mechanism 30 may be disposed on the main body 20 and/or the faucet holder 40. The attachment mechanism 30 may have a first attachment portion 32 and a second attachment portion 34 that matingly engage to form a secure rotational fit. Alternatively, the first attachment portion 32 may be a single or pair of sidewall apertures 32*b* or recesses disposed on the sidewalls 28. Similarly, the first attachment portion 32 may also be a single or pair of inwardly facing protrusions 32*a* or other similar mechanism. The second attachment portion 34 may also be a single or a pair of outwardly facing protrusions 34*a*. Like the first attachment portion 32, the second attachment portion 34 may also be a single or pair of apertures 34*b* or recesses or other similar mechanisms.

As further shown in FIGS. 7-8, the first attachment portion 32 disposed on the sidewalls 28 is a pair of inwardly facing protrusions 32*a*, while the second attachment portion 34 on the faucet holder 40 is a pair of circular recesses 34*b*. The recesses 34*b* can be various shapes, such as circular, or may have a keyed shape to allow limited rotation of the faucet holder 40 relative to the main body 20. That is, the limit on rotation can be substantially between the horizontal to vertical configurations. FIG. 12 is a standalone side view of the faucet holder 40 detached from the main body 20 that shows the pair of circular recesses 34*b*.

As shown in FIGS. 7-8 and 10-11, the inwardly facing protrusions 32*a* may also have at least a shoulder 33. The shoulder 33 provides additional securement to the attachment mechanism 30, so that the first attachment portion 32 may not be undesirably removed from the second attachment portion 34. As shown in FIGS. 10-11, the shoulder 33 of the inwardly facing protrusions 32*a* may have an enlarged protuberance 35 on its end to secure the faucet holder 40 to the main body 20. The enlarged protuberance 35 has a great diameter than the rest of the shoulder 33 and acts as a stop so that the inwardly facing protrusion 32*a* does not come loose from the complementary circular recesses 34*b* of the faucet holder 40.

FIG. 11 is a cross-section facing the second side 24 of the main body 20 at line B-B of FIG. 9 that shows the interaction between the first 32 and second attachment 34 portions. The circular recesses 34*b* of the faucet holder 40 fit securely on the shoulders 33 of the inward facing protrusions 32*a* on the sidewalls 28 of the main body 20. The shape of the inwardly facing protrusions 32*a* are substantially cylindrical, but any shape with a mating and/or complementary portion disposed on the faucet holder 40 is possible.

Figure 24:
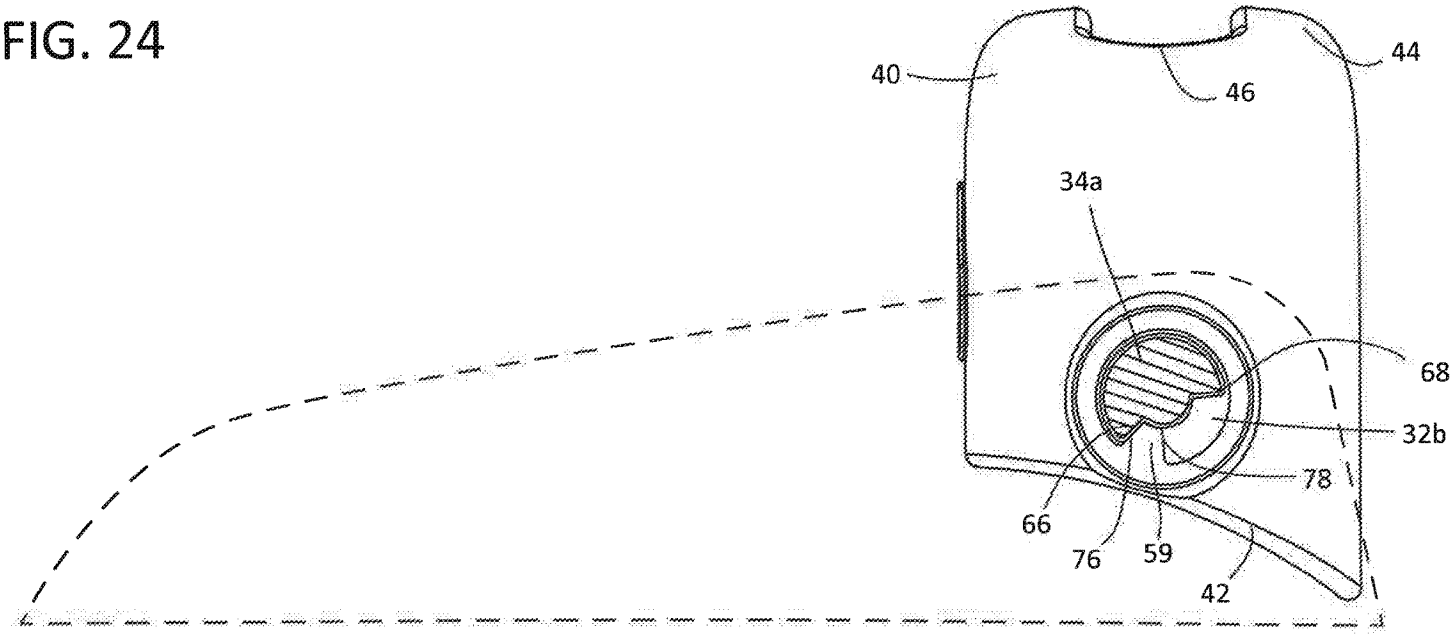
FIG. 24 is a side view of the faucet holder of FIG. 21 with a partial cross section of the attachment mechanism in vertical use position facing inward at line D-D in FIG. 21
Figure 25:
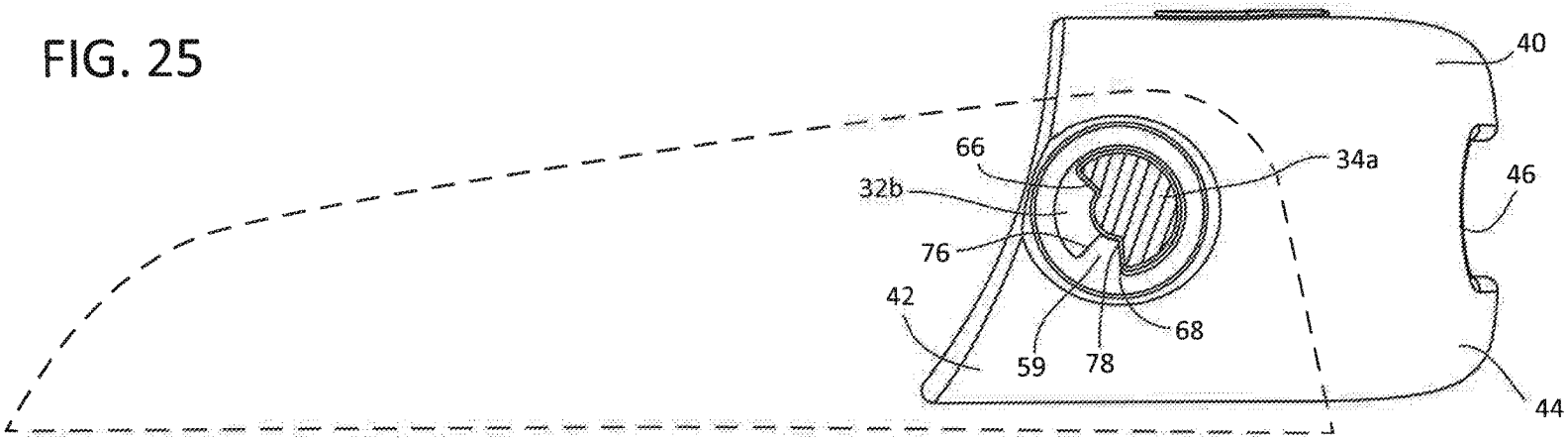
FIG. 25 is a side view of the faucet holder of FIG. 21 with a partial cross section of the attachment mechanism in a horizontal use position facing inward at line D-D in FIG. 21.
Figure 26:
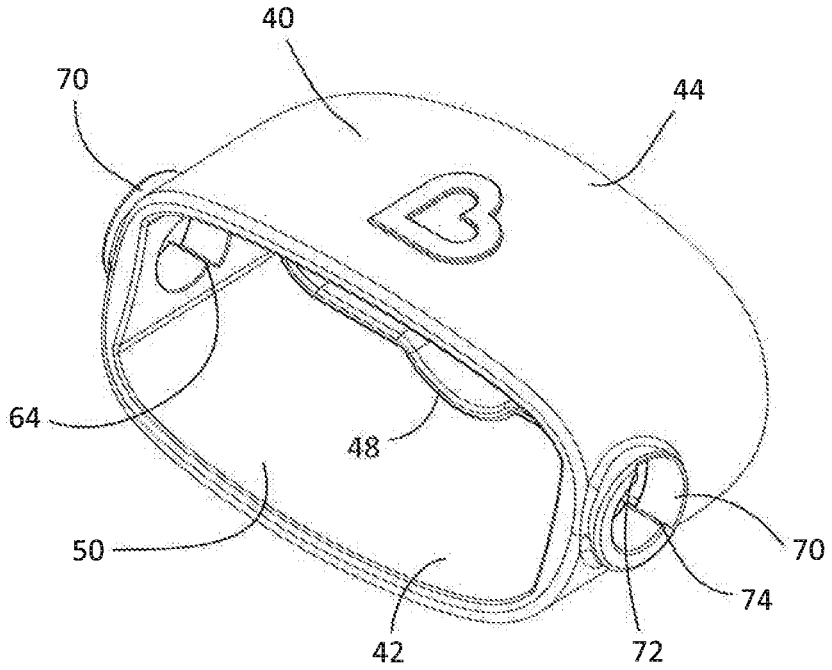
FIG. 26 is a front perspective of the faucet holder with a third embodiment of the attachment mechanism.
Figure 27:
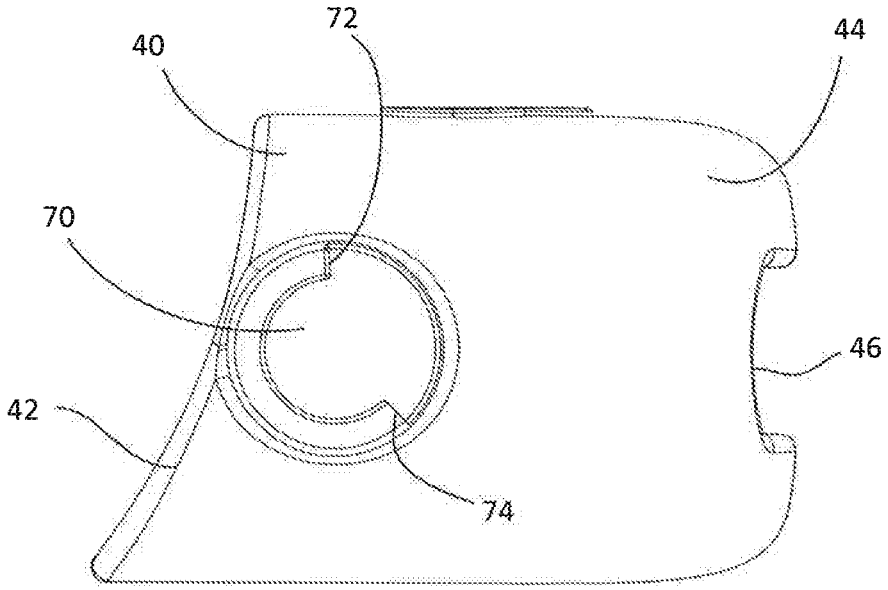
FIG. 27 is a side view of the faucet holder of FIG. 26.

FIGS. 21-25 illustrate exemplary constructions for the attachment mechanism 30 in which the second attachment portion 34 of the faucet holder 40 is an outward facing protrusion 34*a*. FIGS. 22-25 show partial cross-sections of the faucet holder 40 taken at line D-D in FIG. 21. As shown in FIGS. 24 and 25, the outward facing protrusion 34*a* includes keyed surfaces 66 and 68 that are configured to rotationally engage a complementary sidewall locking stop 59 disposed on the circular aperture 32*b* of the sidewall 28 of the main body 20.

The outward facing protrusion 34*a* has a first protrusion stop face 66 and a second protrusion stop face 68. The mating sidewall locking stop 59 has a first sidewall stop surface 76 and a second sidewall stop surface 78. The first protrusion stop face 66 interacts with the first sidewall stop surface 76 of the sidewall locking stop 59. The second protrusion stop face 68 interacts with the second sidewall stop surface 78 of the sidewall locking stop 59. The first sidewall stop surface 76 and the second sidewall stop surface 78 of the sidewall locking stop 59 provide the boundary upon which the outward facing protrusion 34*a*, and therefore the faucet holder 40, is allowed to rotate. For example, in a first vertical position (FIG. 24), the first protrusion stop face 66 may butt up against the first sidewall stop surface 76, and in a second horizontal position (FIG. 25), the second protrusion stop face 68 may butt up against the second sidewall stop surface 78.

Figure 28:
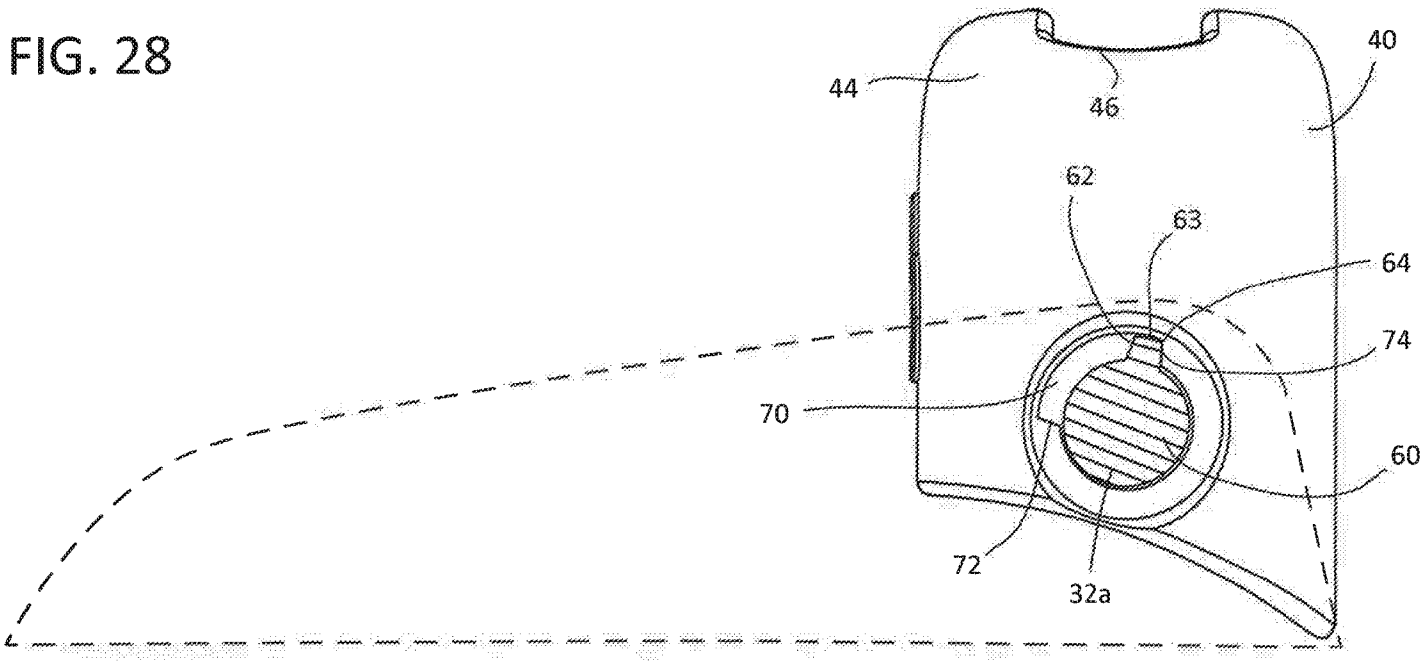
FIG. 28 is a partial cross section of the third embodiment of the attachment mechanism in a vertical use position facing inward at line C-C of FIG. 14.
Figure 29:
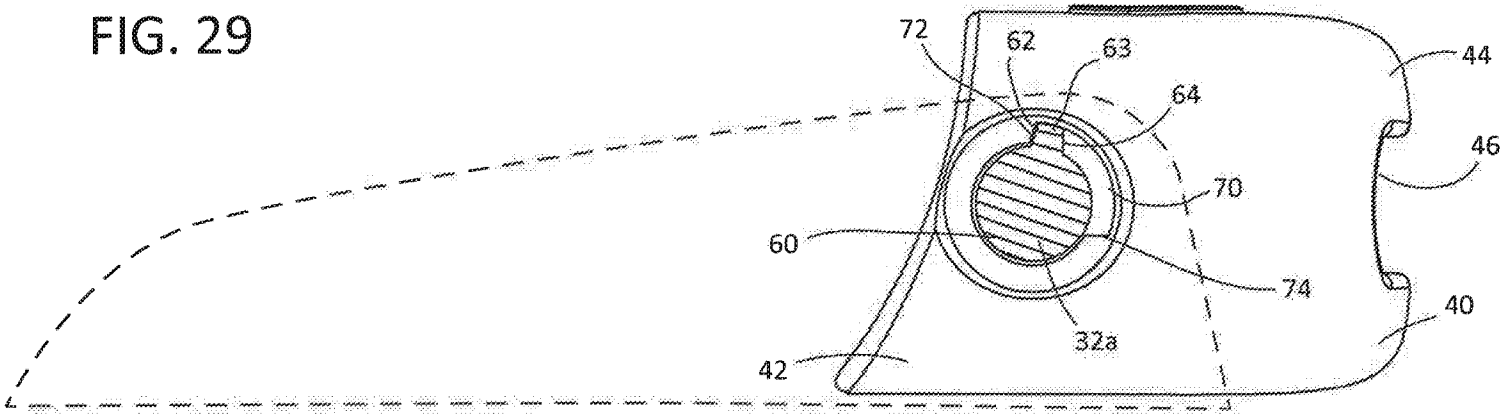
FIG. 29 is a partial cross section of the third embodiment of the attachment mechanism in a horizontal use position facing inward at line C-C of FIG. 14.

FIGS. 28 and 29 illustrate a partial cross section taken at line C-C in FIG. 14 showing another exemplary shape of the inward facing protrusion 32*a*. As shown in FIGS. 28 and 29, the inward facing protrusion 32*a* has a locking stop 60 that has a stop projection 63 with a first stop face 62 and a second stop face 64 disposed therein. The first stop face 62 and second stop face 64 are keyed surfaces that mate with complementary features on the faucet holder 40. The locking stop 60 fits into an opening 70 disposed in the faucet holder 40. As shown in FIGS. 26-29, the opening 70 is configured to mate with the keyed surfaces 62 and 64 of the locking stop 60. As shown in FIGS. 28 and 29, the opening 70 has a first stop surface 72 that interacts with the first stop face 62 of stop projection 63 of the locking stop 60. The opening 70 also has a second stop surface 74 that interacts with the second stop face 64 of the stop projection 63 of the locking stop 60. The first stop surface 72 and the second stop surface 74 provide the boundary upon which the stop projection 63 of the locking stop 60 is allowed to rotate. For example, in a first horizontal position (FIG. 29), the first stop face 62 may butt up against the first stop surface 72, and in a second vertical position (FIG. 28), the second stop face 64 may butt up against the second stop surface 74.

The combination of the first attachment portion 32 and the second attachment portion 34 may be any combination of elements that securely attach the main body 20 and the faucet holder 40. It is further contemplated that a third attachment portion (not shown) may secure the first and second attachment portions 32, 34. For example, in an embodiment having the first and second attachment portions 32, 34 as pairs of mating apertures, a rod may be the third attachment portion rotationally holding the first and second attachment portions 32, 34 together.

Referring back to FIGS. 15-18, the faucet extender 10 may operate with different types and shapes of faucets 90. Due to the versatility of the attachment mechanism 30, the faucet extender 10 may pivot and/or rotate between various positions. More specifically, FIG. 15 contemplates the faucet extender 10 attached to a horizontal faucet end 91 that extends horizontally outwards from the faucet 90. To accomplish this, the faucet holder 40 is positioned horizontally such that the second end 44 having the faucet receiving opening 46 is substantially parallel to the horizontal faucet end 92. When attached to the faucet 90 with the faucet holder 40 in a horizontal receiving position, liquid 100 flows substantially horizontally through the faucet holder 40 and out of the flow through opening 50 and falls at an angle to land in the trough 25 below. The liquid 100 then flows through the trough 25 towards the open edge 26 of the main body 20, where the liquid 100 exits the faucet extender 10.

Figure 16:
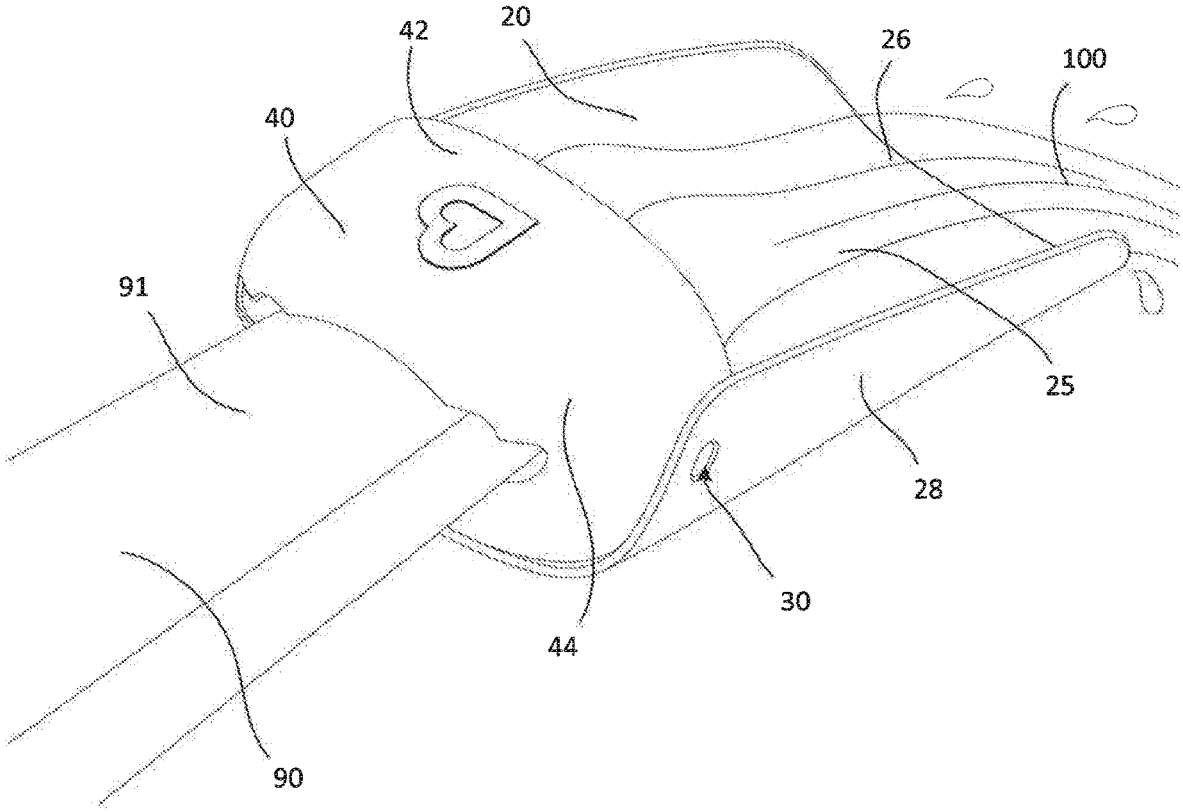
FIG. 16 shows an upper-rear perspective view of the faucet extender depicted in FIG. 1 attached to the faucet in operation.

FIG. 16 shows a rear perspective of the faucet extender 10 attached to the faucet 90 with the faucet holder 40 in a horizontal receiving position. Additionally, FIG. 16 demonstrates the interaction between the faucet receiving opening 46 of the faucet holder 46 and the faucet 90. The horizontal faucet end 91 is reversibly secured by way of friction with the faucet holder 40 such that the friction fit does not interfere with installation or removal.

FIG. 17 shows a side view of the faucet extender 10 attached to a vertical faucet end 92 of a faucet 90 with the faucet holder 40 in a vertical receiving position. In this use position, the faucet holder 40 is positioned vertically such that the second end 44 having the faucet receiving opening 46 is substantially parallel to the vertical faucet end 92. In this position, the liquid 100 flows vertically downward out of the end of the faucet 90 through the faucet holder 40 and falls substantially orthogonal to the trough 25 below. The liquid 100 then flows through the trough 25 towards the open edge 26, where the liquid 100 exits the faucet extender 10.

FIG. 18 illustrates a rear perspective of the faucet extender 10 attached to a faucet 90 with the faucet holder 40 in a vertical receiving position. The faucet end 92 is secured inside the faucet receiving opening 46 by way of a friction fit. Additionally, FIG. 18 demonstrates the interaction between the faucet holder 40 and the second side 24 of the main body 20. In a vertical receiving position, the faucet holder 40 blocks the liquid 100 from exiting off the second end 27 of the main body 20.

Figure 19:
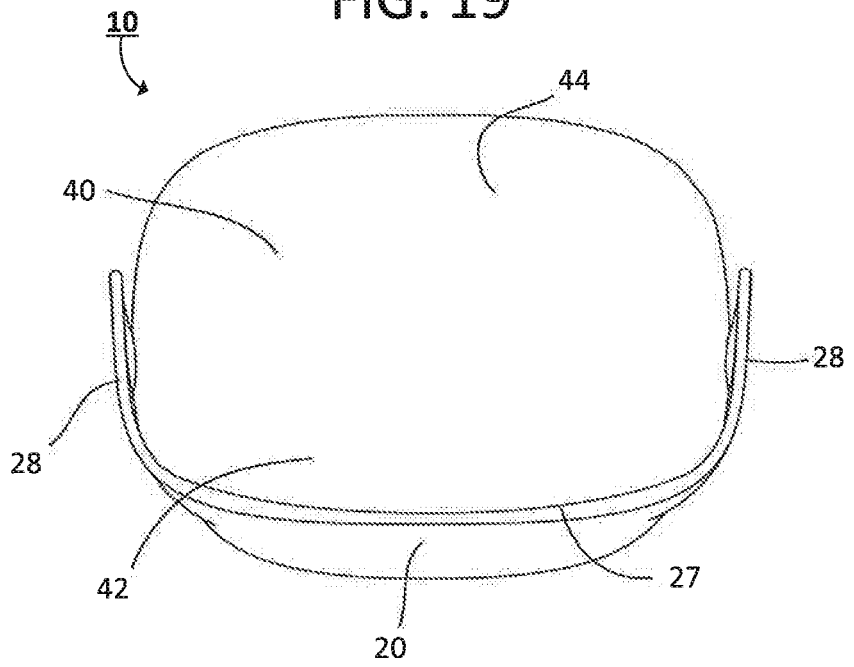
FIG. 19 is a rear view of the faucet extender depicted in FIG. 9.
Figure 20:
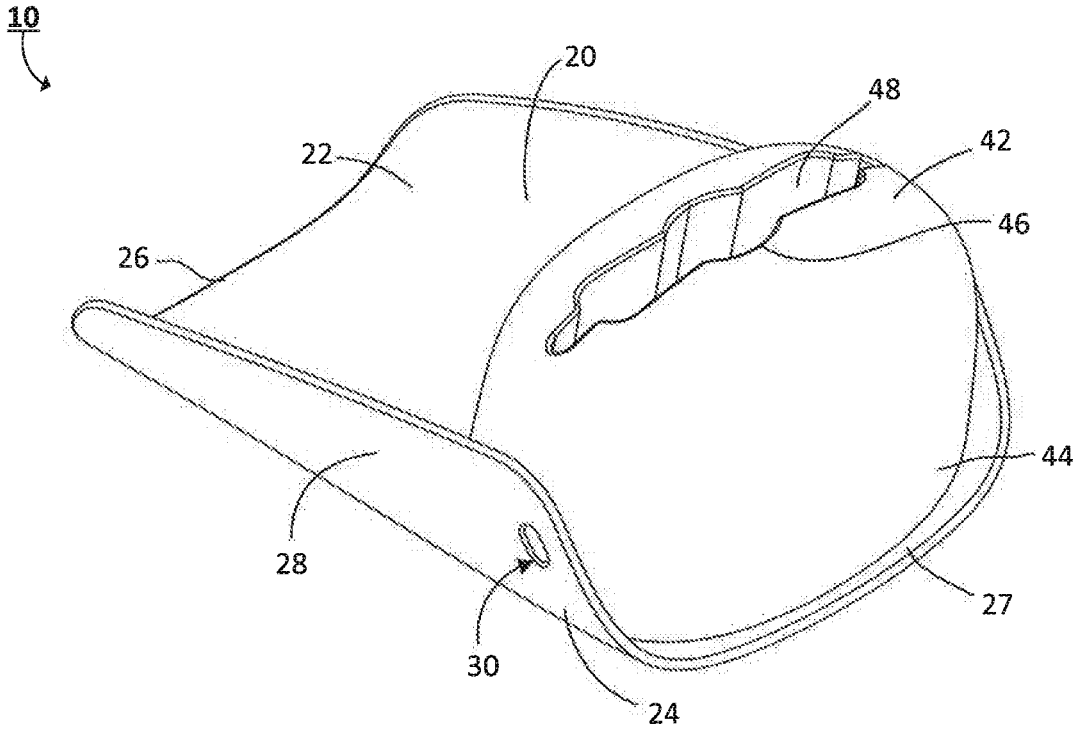
FIG. 20 is a rear perspective view of the faucet extender depicted in FIG. 9.
Figure 21:
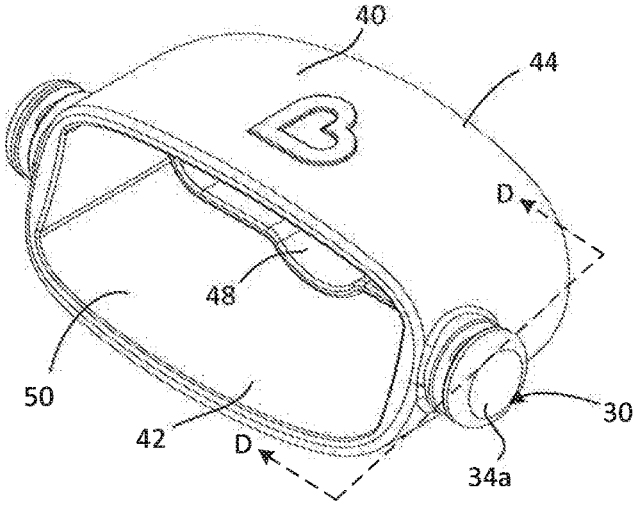
FIG. 21 is a front perspective of the faucet holder with a second embodiment of the attachment mechanism.
Figure 22:
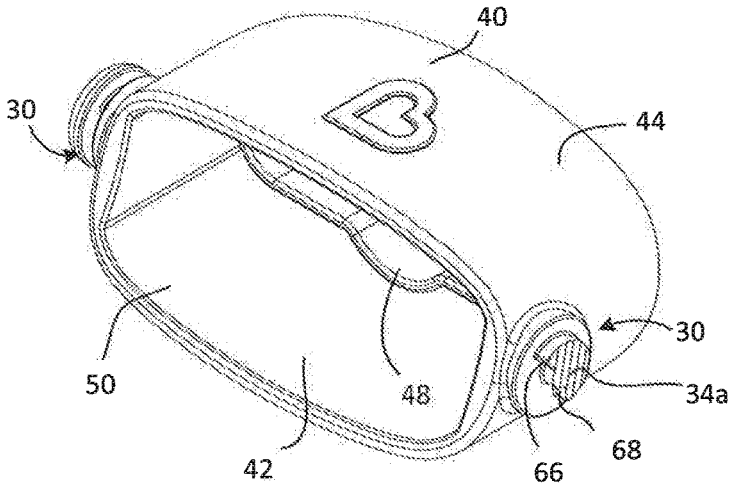
FIG. 22 is a front perspective of the faucet holder of FIG. 21 with a partial cross section of the attachment mechanism facing inward at line D-D in FIG. 21.
Figure 23:
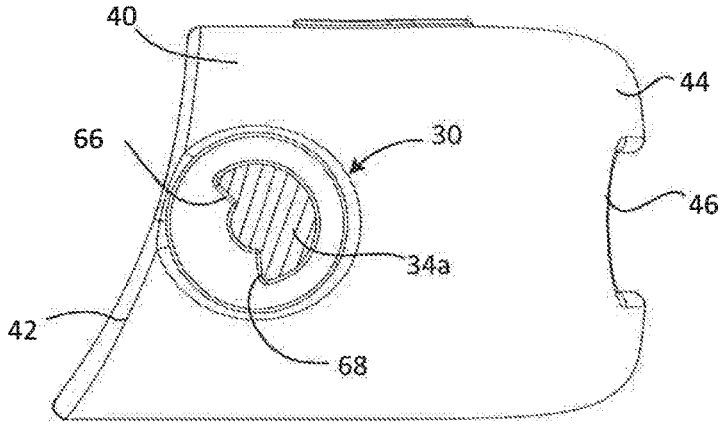
FIG. 23 is a side view of the faucet holder of FIG. 21 with a partial cross section of the attachment mechanism facing inward at line D-D in FIG. 21.

FIG. 19 is a rear view of the faucet extender 10 with the faucet holder 40 in a vertical receiving position. FIG. 19 also shows the faucet holder 40 aligned with the second end 27 of the main body 20 to prevent liquid 100 from spilling off the second end 27. FIG. 20 is a rear perspective of the faucet extender 10 from FIG. 19 that shows the snug fit of the faucet holder 40 within the side walls 28 of the main body 20. This perspective also shows the liquid boundary created at the second end 27 between the main body 20 and the faucet holder 40. When installed in a substantially horizontal, substantially vertical or any similar position, the main body 20 of the faucet extender 10 is angled downwardly away from the faucet 90, such that liquid 100 may be diverted by the trough 25 towards the open edge 26 of the first side 22.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiments described, but is intended to cover all modifications and changes within the scope and spirit of the invention.

What is claimed:

1. A faucet extender comprising:

a channel adapted to extend and divert a fluid out of an open edge away from a faucet outlet;

a fluid outlet fitting having a receiving opening and a flow-through opening, wherein an attachment mechanism pivotally rotates and secures the channel to the fluid outlet fitting between a vertical position and a horizontal position to divert the fluid to the open edge in all positions.

2. The faucet extender recited in claim 1, wherein the attachment mechanism comprises:

a first attachment portion disposed on the channel; and a second attachment portion disposed on the fluid outlet fitting.

3. The faucet extender recited in claim 2, wherein the first attachment portion is at least one of an aperture or an inwardly facing protrusion, and wherein the second attachment portion is at least one of an aperture or an outwardly facing protrusion.

4. The faucet extender recited in claim 2, wherein the first attachment portion and second attachment portion are configured to lock the range of movement of the channel relative to the fluid outlet fitting between a substantially horizontal position to a substantially vertical position.

5. The faucet extender recited in claim 1, wherein the fluid outlet fitting has a faucet receiving opening extending along a central axis that assists in securing the faucet extender to the faucet outlet via a frictional force.

6. The faucet extender recited in claim 5, wherein the faucet receiving opening is a geometric shape having an elongated lip that extends along the central axis to provide more surface are to increase the frictional force.

7. The faucet extender recited in claim 1, wherein a shape of the fluid outlet fitting causes the fluid to flow towards the open edge of the channel away from the faucet outlet.

8. A faucet extender to divert a fluid comprising:

a main body having:

a first side and a second side;

sidewalls attached between the first and second side defining a trough;

an open edge disposed on the first side; and a faucet holder comprising:

a first end and a second end;

a flow-through opening disposed on the first end; and a faucet receiving opening disposed on the second end, wherein an attachment mechanism pivotally secures and rotates the main body to the faucet holder between a vertical position and a horizontal position such that the fluid is diverted by the trough of the main body towards the open edge in all positions.

9. The faucet extender recited in claim 8, wherein the attachment mechanism comprises:

a first attachment portion disposed on the main body; and a second attachment portion disposed on the faucet holder.

10. The faucet extender recited in claim 9, wherein the first attachment portion is at least one of an aperture or an inwardly facing protrusion, and wherein the second attachment portion is at least one of an aperture or an outwardly facing protrusion.

11. The faucet extender recited in claim 9, wherein the first attachment portion and the second attachment portion are configured to lock the range of movement of the main body relative to the faucet holder between a substantially horizontal position to a substantially vertical position.

12. The faucet extender recited in claim 8, wherein the faucet receiving opening is a geometric shape having an elongated lip that extends along the central axis to provide more surface are to increase the frictional force.

13. The faucet extender recited in claim 8, wherein a shape of the faucet holder causes the fluid to flow towards the open edge of the main body away from the faucet outlet.

14. A faucet extender to divert a fluid comprising:

a main body disposed along an elongated axis having:

a first side and a second side;

sidewalls attached parallel to the elongated axis between the first and second side defining a trough;

an open edge disposed on the first side; and a faucet holder comprising:

a first end and a second end disposed along a central axis;

a flow-through opening disposed on the first end; and a faucet receiving opening disposed on the second end, wherein an attachment mechanism is configured to have a keyed surface on a first attachment portion that mates with a locking surface on a second attachment portion that limits the boundary of rotation between the main body and faucet holder between a vertical position and a horizontal position such that the fluid travels towards the open edge and is diverted by the trough of the main body in all positions.

15. The faucet extender recited in claim 14, wherein the attachment mechanism comprises:

the first attachment portion disposed on the main body; and the second attachment portion disposed on the faucet holder.

16. The faucet extender recited in claim 14, wherein the attachment mechanism comprises:

the first attachment portion disposed on the faucet holder; and the second attachment portion disposed on the main body.

17. The faucet extender recited in claim 14, wherein the first attachment portion is at least one of an aperture or an inwardly facing protrusion, and wherein the second attachment portion is at least one of an aperture or an outwardly facing protrusion.

18. The faucet extender recited in claim 14, wherein the faucet receiving opening is a geometric shape having an elongated lip that extends along the central axis to provide more surface are to increase the frictional force.

19. The faucet extender recited in claim 14, wherein a shape of the faucet holder causes the fluid to flow towards the open edge of the main body away from the faucet outlet.

* * * * *